US010827828B2

(12) United States Patent
Tao et al.

(10) Patent No.: US 10,827,828 B2
(45) Date of Patent: Nov. 10, 2020

(54) LIFTING MECHANISM

(71) Applicant: JIANGSU JELT LIFTING SYSTEM CO., LTD, Changzhou (CN)

(72) Inventors: Shengrong Tao, Changzhou (CN); Xiaogang Li, Changzhou (CN)

( * ) Notice: Subject to any disclaimer, the term of this patent is extended or adjusted under 35 U.S.C. 154(b) by 115 days.

(21) Appl. No.: 16/235,760

(22) Filed: Dec. 28, 2018

(65) Prior Publication Data

US 2019/0200749 A1 Jul. 4, 2019

(30) Foreign Application Priority Data

Dec. 29, 2017 (CN) ..... 2017 2 1923263 U

(51) Int. Cl.
*A47B 9/10* (2006.01)
*A47B 9/20* (2006.01)

(52) U.S. Cl.
CPC ..... *A47B 9/10* (2013.01); *A47B 9/20* (2013.01); *A47B 2200/0054* (2013.01)

(58) Field of Classification Search
CPC ..... B66F 1/00; B66F 1/06; B66F 3/24; B66F 3/28; B66F 5/00; B66F 7/04; B66F 9/00
See application file for complete search history.

(56) References Cited

U.S. PATENT DOCUMENTS

| | | | | |
|---|---|---|---|---|
| 3,861,647 | A * | 1/1975 | Meredith | B66F 3/00 254/4 R |
| 4,023,819 | A * | 5/1977 | Holman, Jr. | B60P 7/15 410/151 |
| 8,181,948 | B2 * | 5/2012 | Blick | B23Q 1/032 269/20 |
| 9,796,568 | B1 * | 10/2017 | Gonzales | B66F 5/04 |
| 10,087,058 | B1 * | 10/2018 | Carlson | B66F 3/00 |
| 2019/0200749 | A1 * | 7/2019 | Tao | A47B 9/10 |

FOREIGN PATENT DOCUMENTS

CN 106308039 A 1/2017

* cited by examiner

*Primary Examiner* — Lee D Wilson
(74) *Attorney, Agent, or Firm* — Bayramoglu Law Offices LLC

(57) ABSTRACT

The invention relates to a lifting mechanism which uses fluid as a damping medium to form a driving force. It has an outer tube, an inner tube and a spring using fluid as a damping medium to achieve a lifting effect, one end of the inner tube being inserted in the outer tube from one end of the outer tube, and one end of the spring being positioned in the outer tube; the other end of the spring penetrating through the inner tube and being connected with the inner tube.

10 Claims, 8 Drawing Sheets

LIFTING MECHANISM

CROSS-REFERENCE TO RELATED APPLICATIONS

This application claims priority to Chinese Patent Application No. 201721923263.5 with a filing date of Dec. 29, 2017. The content of the aforementioned application, including any intervening amendments thereto, is incorporated herein by reference.

TECHNICAL FIELD

The present invention relates to a lifting mechanism which uses fluid as a damping medium to form a driving force.

BACKGROUND ART

A table which serves as an article for daily life is common in life, work and school learning. Along with improvement of living quality of people, requirements for functions of the table are more and more, for example, a requirement for the lifting function of the table is one of the requirements.

At present, lifting of most of tables is realized by gas spring mechanisms mounted on table legs, for example, an invention patent with the publication number being CN106308039A discloses a lifting device, and the lifting device comprises a spring which provides a holding force after lifting and uses fluid as a damping medium, a first sleeve and a second sleeve; one end of the spring is positioned in the first sleeve and is fixedly connected with one end of the first sleeve; one end of the second sleeve is inserted in the first sleeve from the other end of the first sleeve, the other end of the spring penetrates through the second sleeve, the spring and the second sleeve are fixedly connected, and a guiding assembly used for the second sleeve to lift is arranged on the first sleeve and/or the second sleeve; and the guiding assembly is a rolling friction assembly or a sliding friction assembly.

In the lifting device, when the guiding assemblies are rolling friction assemblies, the rolling friction assemblies are fixedly arranged on the first sleeve and the second sleeve separately, and when the spring lifts to push the second sleeve to lift, for the rolling friction assembly fixedly arranged on the first sleeve, the rolling element in the rolling friction assembly rotates under a friction force between the rolling element of the rolling friction assembly and the outer wall surface of the second sleeve. For the rolling friction assembly fixedly arranged at an end of the second sleeve, when the rolling friction assembly moves along with the second sleeve, the rolling element rotates under a friction force between the rolling element and the inner wall surface of the first sleeve.

However, because a mode of connecting the rolling friction assembly mounted at an end of the first sleeve with the first sleeve and a mode of connecting the rolling friction assembly mounted at an end of the second sleeve with the second sleeve are fixed connection modes, the friction force between the first sleeve and the second sleeve is large, and the large friction force has a hindering effect on lifting of the spring.

SUMMARY OF THE UTILITY MODEL

The invention aims to provide a lifting mechanism for reducing frictional resistance of an inner tube in lifting.

The technical solution for solving the technical problem is as follows:

The lifting mechanism comprises an outer tube, an inner tube and a spring using fluid as a damping medium to achieve a lifting effect, one end of the inner tube is inserted in the outer tube from one end of the outer tube, and one end of the spring is positioned in the outer tube; the other end of the spring penetrates through the inner tube and is connected with the inner tube, the lifting mechanism further comprises a floating guiding assembly, the floating guiding assembly is sleeved over the inner tube and is positioned between the outer tube and the inner tube, the surface of the floating guiding assembly is in contact with the outer wall surface of the inner tube and the inner wall surface of the outer tube separately, and when the inner tube lifts along with the spring, the floating guiding assembly axially moves relative to the inner tube and the outer tube under a friction force.

The invention has the advantages that movement of the floating guiding assembly is implemented by the friction force, therefore, the movement speed of the floating guiding assembly is smaller than the movement speed of the inner tube, and thus, a speed difference exists between the floating guiding assembly and the inner tube; because the outer tube is fixedly arranged, the floating guiding assembly moves relative to the outer tube; the floating guiding assembly axially moves relative to the inner tube and the outer tube under the friction force, thus, the guiding assembly further has an effect of reducing the friction force while guiding the inner tube, and thus, the inner tube lifts more smoothly.

DETAILED DESCRIPTION OF THE UTILITY MODEL

Embodiment 1

Figure 1:
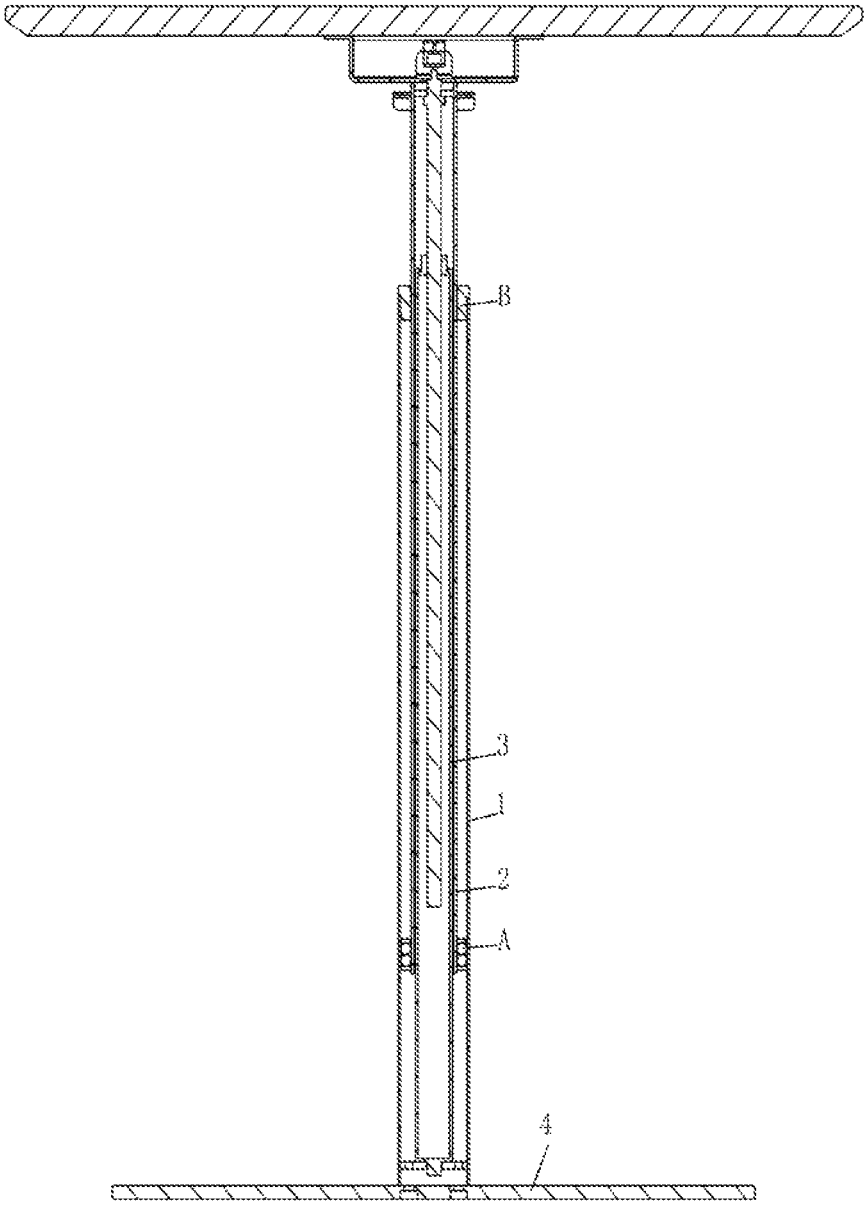
FIG. 1 is a schematic sectional view of a lifting mechanism of the present utility model in a first embodiment.
Figure 2:
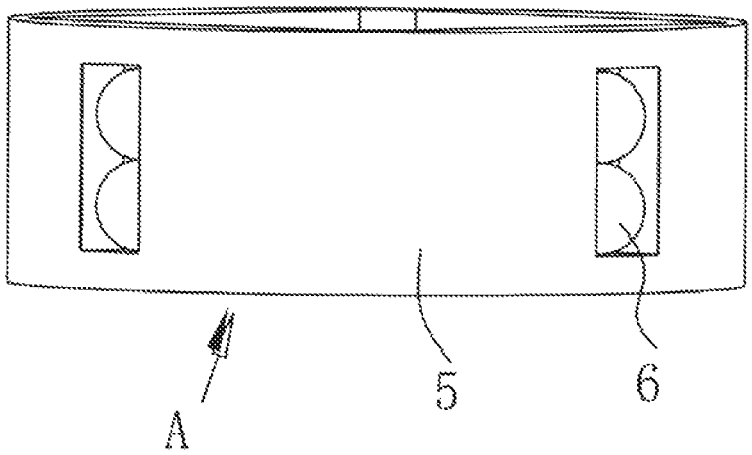
FIG. 2 is schematic diagram of a floating guiding assembly in the first embodiment.

As shown in FIG. 1 and FIG. 2, a lifting mechanism of the present utility model comprises an outer tube 1, an inner tube 2, a spring 3 using fluid as a damping medium to achieve a lifting effect, and a floating guiding assembly A, the various portions and the relationship between the portions will be described in detail below:

As shown in FIG. 1, one end of the inner tube 2 is inserted in the outer tube 1 from the other end of the outer tube 1, one end of the spring 3 is positioned in the outer tube 1, one end of the spring 3 penetrates through the inner tube 2 and is connected with the inner tube 2, the spring 3 penetrates through the floating guiding assembly and then penetrates through the inner tube 2, and the spring 3 and the inner tube 2 can be directly connected (such as welding or threaded connection or hinging), and can also be indirectly connected by an added connector (not shown in the figures). The spring 3 is a gas spring preferably. In one or more embodiments, the outer tube 1 is fixedly connected with a base 4, therefore, when the lifting mechanism lifts, the outer tube 1 keeps still, and the inner tube 2 moves relative to the outer tube 1.

As shown in FIG. 1 and FIG. 2, the floating guiding assembly A is sleeved over the inner tube 2 and is positioned between the outer tube 1 and the inner tube 2, the surface of the floating guiding assembly A is in contact with the outer wall surface of the inner tube 2 and the inner wall surface of the outer tube 1 separately, and when the inner tube 2 lifts along with the spring 3, the floating guiding assembly axially moves relative to the inner tube and the outer tube under a friction force. The floating guiding assembly A is a rolling friction assembly preferably. When the inner tube 2 lifts, a friction force is generated between the inner tube 2 and the floating guiding assembly A, and by the friction force, the floating guiding assembly moves. Movement of the floating guiding assembly A is implemented by the friction force, therefore, the movement speed of the floating guiding assembly A is smaller than the movement speed of the inner tube 2, and a speed difference exists between the floating guiding assembly and the inner tube 2; and because the outer tube 1 is fixedly arranged, the floating guiding assembly A moves relative to the outer tube 1.

As shown in FIG. 1 and FIG. 2, the floating guiding assembly A is a rolling friction assembly preferably, the rolling friction assembly comprises a first retainer 5 and first rolling elements 6, through holes are formed in the peripheral surface of the first retainer 5, the first rolling elements 6 are spherical rolling elements preferably, the spherical rolling elements are steel balls preferably, and after the first rolling elements 6 are assembled in the through holes of the first retainer 6, the surfaces of the first rolling elements 6 are in contact with the outer wall surface of the inner tube 2 and the inner wall surface of the outer tube 1 separately. The outer tube 1 and the inner tube 2 can be cylinders, and can also be prisms, in this embodiment, the outer tube 1 is a cylinder preferably, the inner tube 2 is a prism preferably, therefore, the cross section of the outer peripheral surface of the first retainer 5 is circular, the cross section of the inner peripheral surface of the first retainer 5 is polygonal, for example, the cross section of the inner peripheral surface of the first retainer 5 is rectangular, and thus, the shape of the first retainer 5 is separately matched with the shape of the outer tube 1 and the shape of the inner tube 2.

As shown in FIG. 1 and FIG. 2, a second guiding assembly B used for the inner tube 2 to lift is fixedly arranged at the end, which allows the inner tube to be inserted, of the outer tube 1, the second guiding assembly B can be a rolling friction assembly, and can also be a sliding friction assembly, in this embodiment, the second guiding assembly B is the rolling friction assembly preferably, the second guiding assembly B consists of second rolling elements and a second retainer with through holes, a groove is formed in the inner peripheral surface of the second retainer, and the second rolling elements are positioned in the groove, and are in contact with the outer peripheral surface of the inner tube 2. By the floating guiding assembly A and the second guiding assembly B, the inner tube 2 cannot shake in the lifting process, namely, the lifting process is more stable.

Embodiment 2

Figure 3:
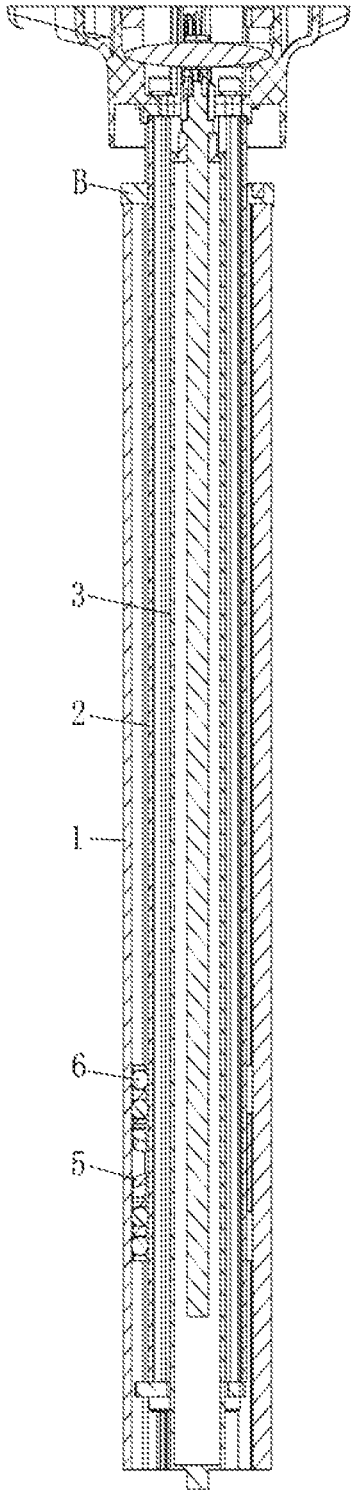
FIG. 3 is a schematic diagram of a sectional structure of the lifting mechanism of the present utility model in a second embodiment.
Figure 4:
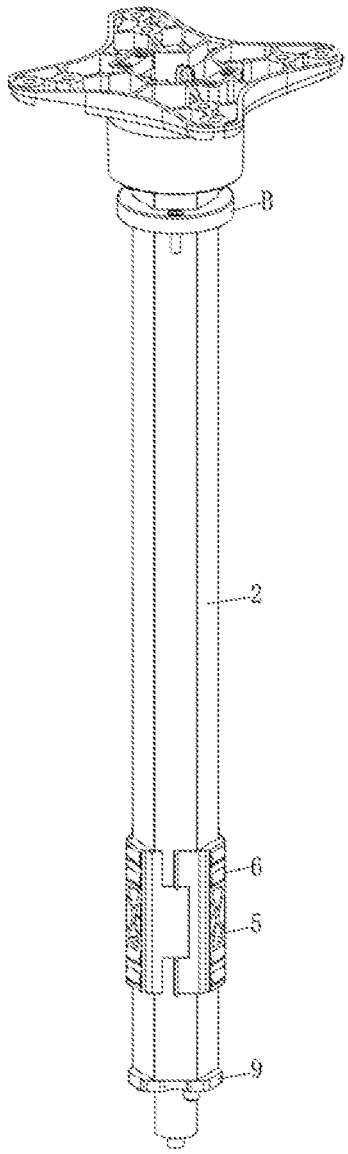
FIG. 4 is a three-dimensional view of the lifting mechanism of the present utility model after an outer tube is concealed in the second embodiment.
Figure 5:
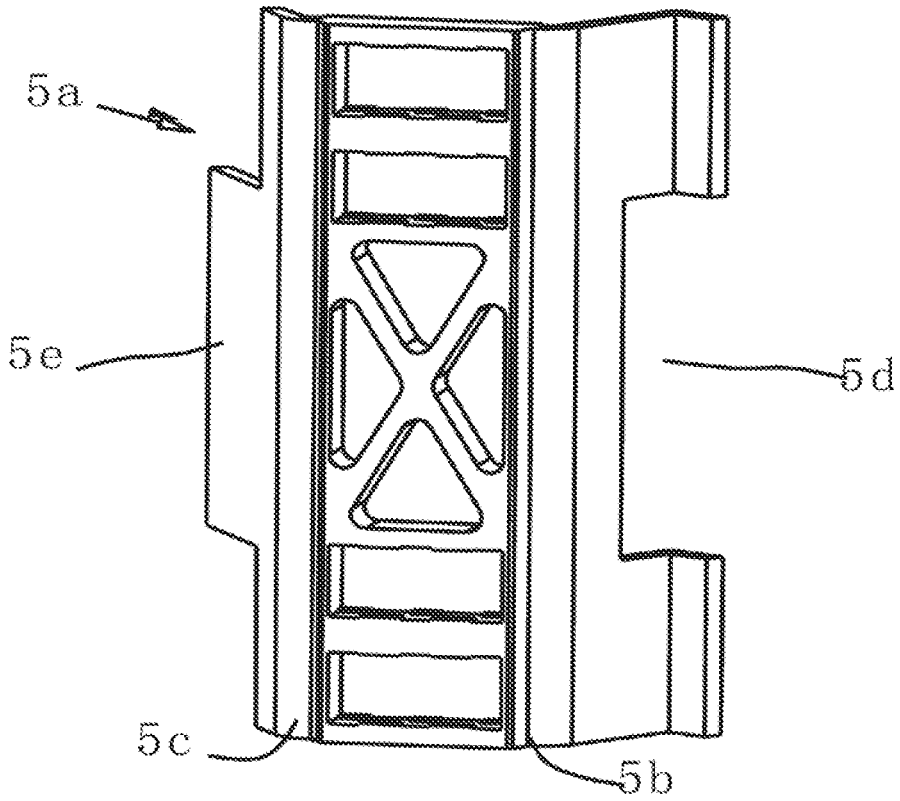
FIG. 5 is a schematic diagram of splicing components in the second embodiment.

As shown in FIG. 3 to FIG. 5, the cross section of the inner tube 2 is polygonal, preferably, the cross sections of the outer peripheral surface and the inner peripheral surface of the inner tube 2 are both orthohexagonal, for the floating guiding assembly A, the first retainer 5 is formed by splicing a plurality of splicing components 5*a*, each splicing component 5*a* is provided with a through hole for assembling the corresponding first rolling element 6, in this embodiment, each first rolling element 6 is a cylindrical rolling element preferably, each cylindrical rolling element is a plastic or iron rolling element, one end of each splicing component 5*a* is bent to form a first bent portion 5*b* which is matched with the two adjacent surfaces on the inner tube 2, the other end of each splicing component 5*a* is bent to form a second bent portion 5*c* which is matched with the two adjacent surfaces on the inner tube 2, after the splicing components Sa are matched with the inner tube, the first bent portion 5*b* of an optional splicing component 5*a* is spliced with the second bent portion 5*c* of the other adjacent splicing component 5*a*.

As shown in FIG. 4 and FIG. 5, according to a preferable structure mode for splicing between each first bent portion 5*b* and the corresponding second bent portion Sc, a notch 5*d* is formed in each first bent portion 5*b*, a protrusion 5*e* is arranged at one end of each second bent portion 5*c*, and the protrusion Se on each second bent portion 5*c* is embedded in the corresponding notch 5*d* to implement splicing.

As shown in FIG. 3 to FIG. 5, for the second guiding assembly B, the second guiding assembly B is a plastic sleeve preferably, and the shape of the inner peripheral surface of the sleeve is matched with that of the outer peripheral surface of the inner tube 2.

The rest structures are the same as the structures in embodiment 1, and the description thereof will not be repeated herein.

Embodiment 3

Figure 6:
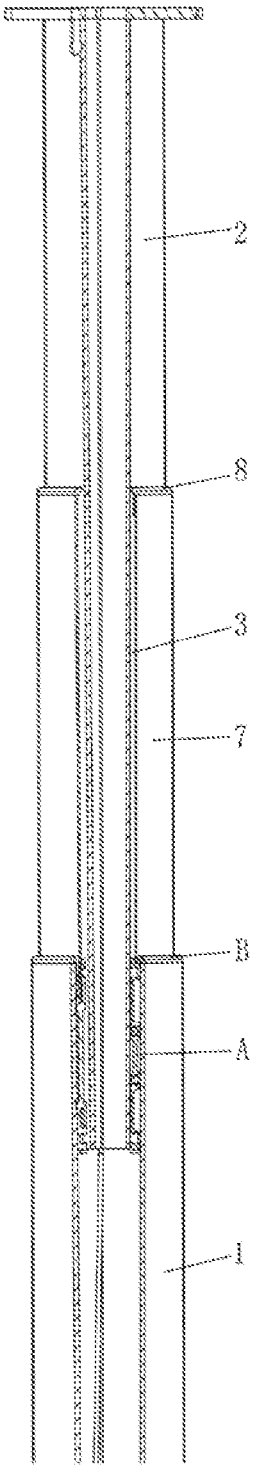
FIG. 6 is a schematic sectional view of the lifting mechanism of the present utility model in a third embodiment.
Figure 7:
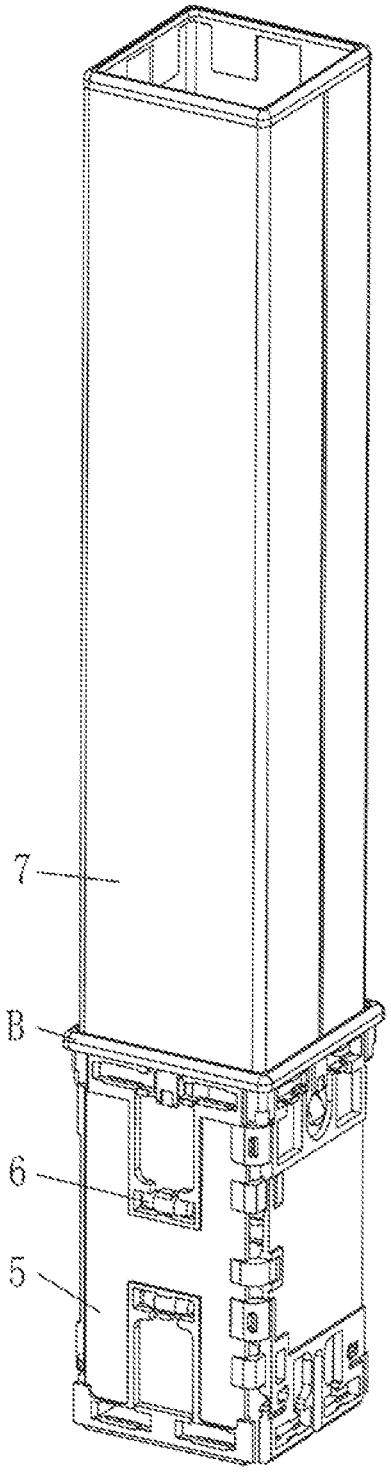
FIG. 7 is a three-dimensional view of the lifting mechanism of the present utility model after the outer tube and the inner tube are concealed in the third embodiment.
Figure 8:
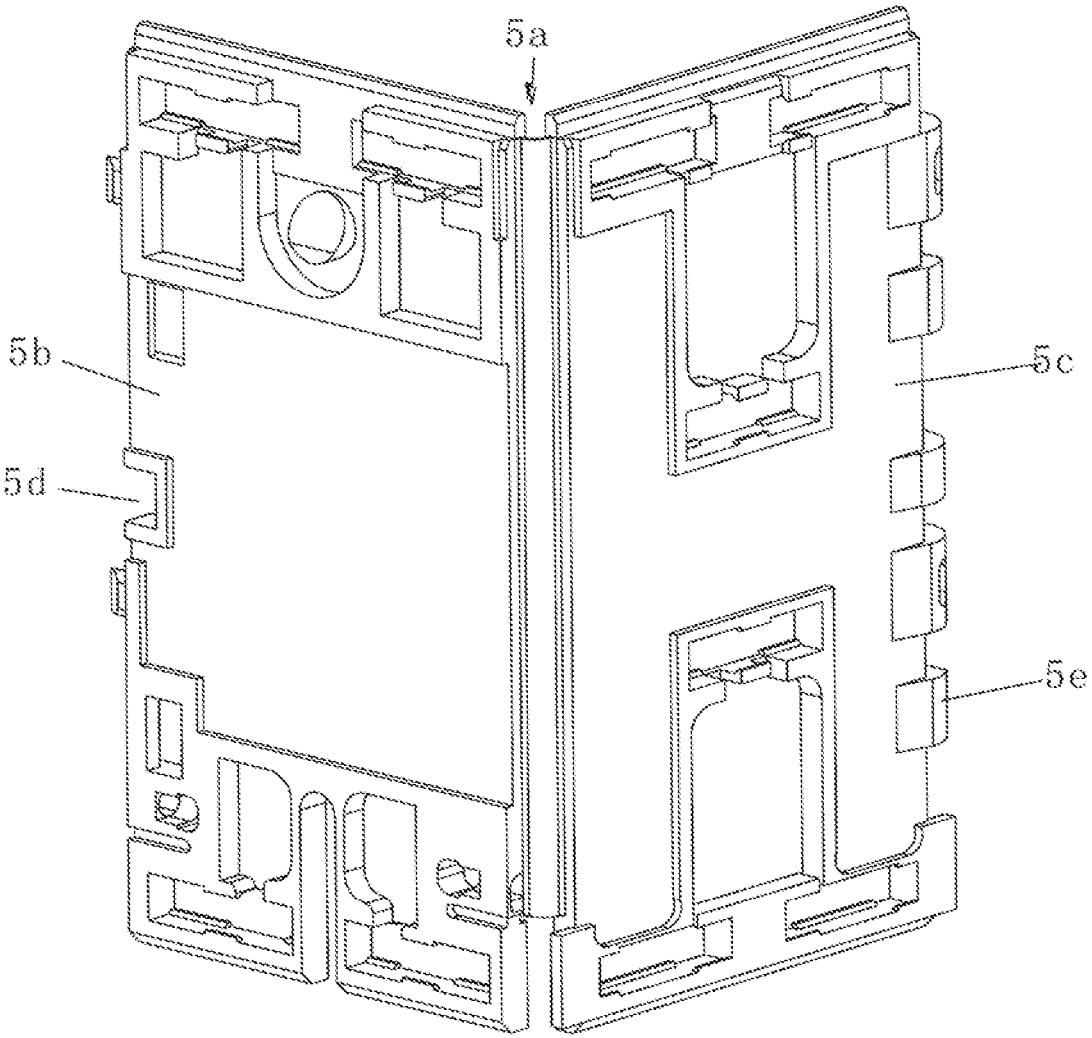
FIG. 8 is a schematic diagram of the splicing components in the third embodiment.

As shown in FIG. 6 to FIG. 8, the floating guiding assembly A in this embodiment is a variant of the floating guiding assembly A in embodiment 2, a notch 5*d* is formed in each first bent portion 5*b*, a protrusion Se is arranged at one end of each second bent portion 5*c*, and the protrusion 5*e* on each second bent portion 5*c* is fastened in the corresponding notch 5*d* to implement splicing.

In addition, for the three foregoing embodiments, when the floating guiding assembly is a rolling friction assembly, the rolling friction assembly further comprises a sleeve 7, as shown in FIG. 6 to FIG. 8, the sleeve 7 is sleeved over the inner tube 2, one end of the sleeve 7 extends towards the rising direction of the inner tube 2, the other end of the sleeve 7 is fixedly connected with the first retainer 5, and the sleeve 7 moves along with movement of the first retainer. After an end of the first retainer 5 is connected with the sleeve 7, part of the sleeve 7 may be exposed to the outside of the outer tube 1 in the rising process of the sleeve 7, when the part of the sleeve 7 is exposed to the outside of the outer tube 1, three tubes including the outer tube 1, the sleeve 7 and the inner tube 2 can be seen when the lifting mechanism of the present utility model is observed from the outside, and the inner tube 2 and the sleeve 7 lift. The structure is more attractive when seen from the outside, meanwhile, the sleeve 7 surrounds part of the inner tube 2, some lubricating oil may be added in the outer tube 1 generally, the lubricating oil may be attached to the surface of the inner tube 2, when the inner tube 2 lifts, the lubricating oil which is attached to the surface of the inner tube 2 lifts along with the inner tube 2, and when the inner tube 2 extends to the outside of the outer tube 1, the lubricating oil is prevented from being exposed in air owing to the surrounding effect of the inner tube 2.

Moreover, a first guiding assembly 8 used for the sleeve to lift is fixedly arranged at the end, which extends towards the rising direction of the inner tube 2, of the sleeve 7, thus, the two ends of the sleeve 7 are guided and supported, and the sleeve 7 is more stable during lifting.

Moreover, a limiting component 9 which limits the floating guiding assembly against slipping off from the inner tube under the effect of gravity is arranged at the end, which is positioned in the outer tube, of the inner tube. The limiting component 9 can be fixedly arranged at the end of the inner tube 2 through a screw, and can also be integrally formed at the end of the inner tube 2; and the limiting component 9 can be further arranged on the outer peripheral surface of the inner tube 2, and when arranged on the outer peripheral surface, the limiting component 9 can be integrally formed with the inner tube, and can also be fastened by a screw.

What is claimed is:

1. A lifting mechanism, comprising an outer tube, an inner tube and a spring using fluid as a damping medium to achieve a lifting effect, one end of the inner tube being inserted in the outer tube from one end of the outer tube, and one end of the spring being positioned in the outer tube; an other end of the spring penetrating through the inner tube and being connected with the inner tube, wherein the lifting mechanism further comprises a floating guiding assembly, the floating guiding assembly being sleeved over the inner tube and being positioned between the outer tube and the inner tube, a surface of the floating guiding assembly being in contact with an outer wall surface of the inner tube and an inner wall surface of the outer tube separately, and the floating guiding assembly axially moves relative to the inner tube and the outer tube when the inner tube lifts along with the spring.

2. The lifting mechanism according to claim 1, wherein the floating guiding assembly is a rolling friction assembly.

3. The lifting mechanism according to claim 2, wherein the rolling friction assembly comprises a first retainer and first rolling elements, through holes are formed in a peripheral surface of the first retainer, and after the first rolling elements are assembled in the through holes of the first retainer, a plurality of surfaces of the first rolling elements are in contact with the outer wall surface of the inner tube and the inner wall surface of the outer tube separately.

4. The lifting mechanism according to claim 3, wherein a cross section of the inner tube is polygonal, the first retainer is formed by splicing a plurality of splicing components, each splicing component of the plurality of splicing components is provided with a through hole for assembling a corresponding first rolling element of the first rolling elements, one end of each splicing component of the plurality of splicing components is bent to form a first bent portion, wherein the first bent portion is matched with two adjacent surfaces on the inner tube, an other end of each splicing component of the plurality of splicing components is bent to form a second bent portion, wherein the second bent portion is matched with the two adjacent surfaces on the inner tube, after the plurality of splicing components are matched with the inner tube, the first bent portion of an optional splicing component is spliced with the second bent portion of an other adjacent splicing component.

5. The lifting mechanism according to claim 4, wherein a notch is formed in each first bent portion, a protrusion is arranged at one end of each second bent portion, and the protrusion on the each second bent portion is embedded in a corresponding notch to implement a combination.

6. The lifting mechanism according to claim 3, wherein the rolling friction assembly further comprises a sleeve, the sleeve is sleeved over the inner tube, one end of the sleeve extends towards a rising direction of the inner tube, an other end of the sleeve is fixedly connected with the first retainer, and the sleeve moves along with a movement of the first retainer.

7. The lifting mechanism according to claim 6, wherein a first guiding assembly used for lifting the sleeve is fixedly arranged at an end of the sleeve, wherein the sleeve extends towards the rising direction of the inner tube.

8. The lifting mechanism according to claim 3, wherein a second guiding assembly used for lifting the inner tube is fixedly arranged at an other end of the outer tube, wherein the outer tube allows the inner tube to be inserted.

9. The lifting mechanism according to claim 1, wherein a limiting component limits the floating guiding assembly against slipping off from the inner tube under an effect of gravity is arranged at the end of the inner tube, wherein the inner tube is positioned in the outer tube.

10. The lifting mechanism according to claim 1, wherein the spring is a gas spring.

* * * * *